US009049511B2

(12) United States Patent
Shen

(10) Patent No.: US 9,049,511 B2
(45) Date of Patent: Jun. 2, 2015

(54) DIAPHRAGM AND SPEAKER USING SAME

(71) Applicant: Tao Shen, Shenzhen (CN)

(72) Inventor: Tao Shen, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 14/195,072

(22) Filed: Mar. 3, 2014

(65) Prior Publication Data

US 2014/0284135 A1 Sep. 25, 2014

(30) Foreign Application Priority Data

Mar. 19, 2013 (CN) ..... 2013 2 0125786 U

(51) Int. Cl.
*H04R 7/10* (2006.01)
*H04R 7/06* (2006.01)

(52) U.S. Cl.
CPC ... *H04R 7/06* (2013.01); *H04R 7/10* (2013.01)

(58) Field of Classification Search
CPC ..... H04R 7/10; H04R 7/125; H04R 2307/025
USPC ..... 181/170
See application file for complete search history.

(56) References Cited

U.S. PATENT DOCUMENTS

2011/0216923 A1* 9/2011 Chiang et al. ..... 381/186
2011/0272208 A1* 11/2011 Shen ..... 181/170

* cited by examiner

*Primary Examiner* — Jeremy Luks
(74) *Attorney, Agent, or Firm* — IPro, Inc.; Na Xu

(57) ABSTRACT

A diaphragm is disclosed in the present disclosure. The diaphragm includes a middle layer, a first and a second adhesive layer attached on two side surfaces of the middle layer respectively, and a first layer adhered to the middle layer by the first adhesive layer and a second layer adhered to the middle layer by the second adhesive layer. The first adhesive layer is made of acrylic adhesive and the second adhesive layer is made of silica gel. A speaker using the diaphragm described above is also disclosed. The diaphragm can be used in a relatively wide temperature range and has a strong adaptability to the environment.

3 Claims, 2 Drawing Sheets

DIAPHRAGM AND SPEAKER USING SAME

FIELD OF THE INVENTION

The present disclosure relates to the art of electro-acoustic transducers, and more particularly to a diaphragm used in a speaker.

DESCRIPTION OF RELATED ART

Speakers are widely used in portable electronic devices such as mobile phones, notebook computers and hearing aids. As such portable electronic devices are developing rapidly, requirements on functions thereof become ever higher. Correspondingly, speakers used in these portable electronic devices are also experiencing rapid development.

In related arts of speaker, a diaphragm for generating sounds is of a five-layer structure. The diaphragm comprises a middle layer, an upper and a lower adhesive layers attached on two opposed surfaces of the middle layer respectively, and covering layers attached on the upper and the lower adhesive layers respectively. The upper adhesive layer and the lower adhesive layer are made of the same material.

However, because the upper adhesive layer and the lower adhesive layer are made of the same material, the diaphragm has a relatively poor adaptability to the environment and is unable to satisfy the increasingly more stringent service requirements.

Accordingly, there is a need to provide a new technical solution to overcome the aforesaid shortcomings.

DETAILED DESCRIPTION OF EXEMPLARY EMBODIMENT OF THE INVENTION

Hereinbelow, the present disclosure will be described in detail with reference to an exemplary embodiment of the present disclosure.

Figure 1:
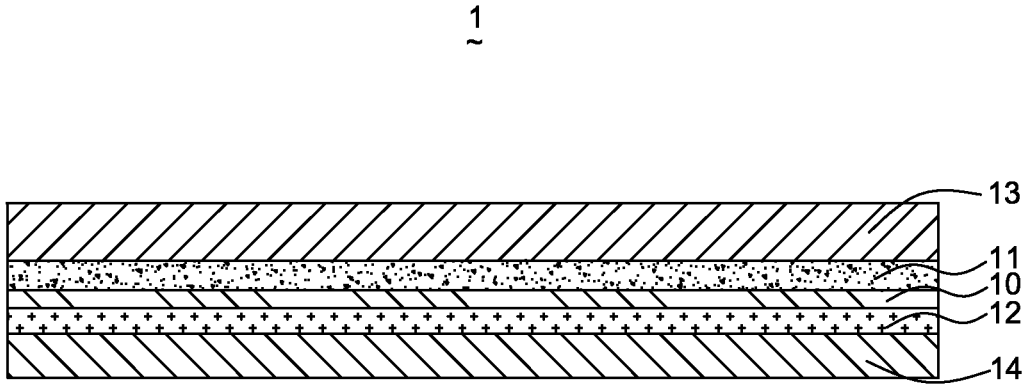
FIG. 1 is a schematic view of a diaphragm according to an exemplary embodiment of the present disclosure.

As shown in FIG. 1, a diaphragm 1 in accordance with an exemplary embodiment of the present disclosure comprises a middle layer 10, a first adhesive layer 11 and a second adhesive layer 12 attached on two side surfaces of the middle layer 10 respectively, and a first layer 13 adhered to the middle layer 10 by the first adhesive layer 11 and a second layer 14 adhered to the middle layer 10 by the second adhesive layer 12.

Optionally, the first adhesive layer 11 is made of acrylic adhesive and the second adhesive layer 12 is made of silica gel, the middle layer 10 is made of polyethylene terephthalate (PET), and the first layer 13 and the second layer 14 are respectively made of one of polyetherimide (PEI), polyarylate (PAR) and polyethylene naphthalate (PEN).

By virtue of the configuration described above, the diaphragm can sustain higher environmental temperature range and is further provided with improved environmental adaptability. Furthermore, by implementing the first layer 13 and the second layer 14 as films made of polymer materials with a high tensile strength such as polyetherimide (PEI), polyacrylate (PAR), and PEN, the tensile strength of the diaphragm as a whole can be effectively improved.

Figure 2:
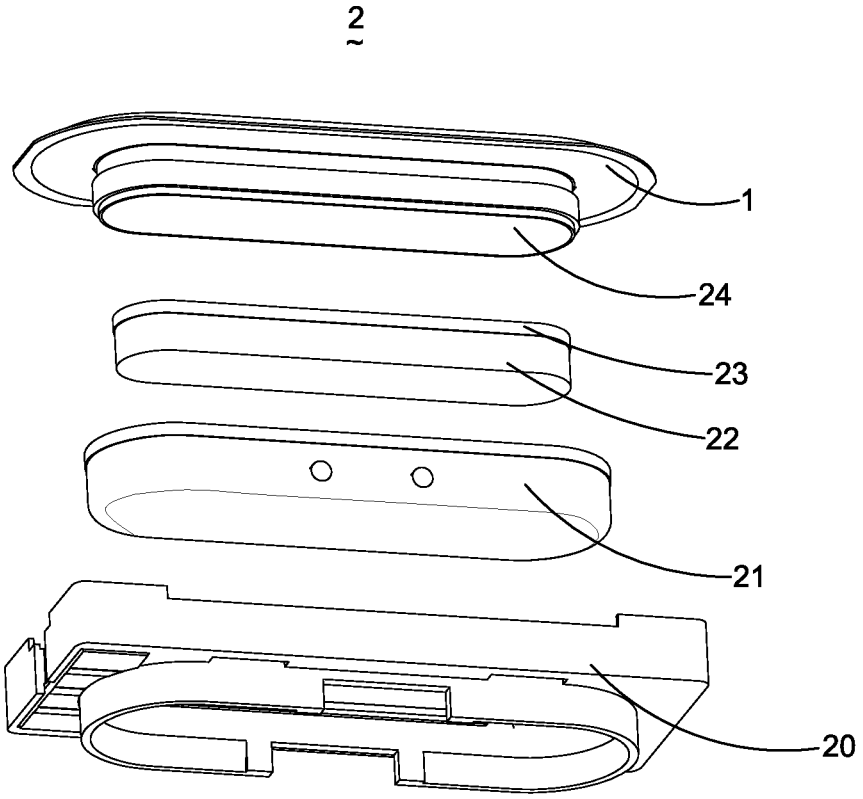
FIG. 2 is an exploded isometric view of a speaker using the diaphragm shown in FIG. 1.

As shown in FIG. 2, there is shown a speaker 2 using the diaphragm 1 described above. The speaker 2 comprises a frame 20, a yoke 21 received in the frame 20, a magnet 22 received in the yoke 21 and forming a magnetic gap (not labeled) with the yoke 21, a pole plate 23 attached on a surface of the magnet 22, and a voice coil 24 having an end partially received in the magnetic gap. The other end of the voice coil 24 is fixed to the diaphragm 1 for driving the diaphragm to vibrate.

What described above is only exemplary embodiment of the present disclosure. It shall be appreciated that, for those of ordinary skill in the art, modifications may be made thereto without departing from the inventive concepts of the present disclosure, and all these modifications shall fall within the scope of the present disclosure.

What is claimed is:

1. A diaphragm, comprising:

a middle layer, a first adhesive layer attached to one side of the middle layer;

a second adhesive layer attached to the other side of the middle layer;

a first layer adhered to the middle layer by the first adhesive layer, and a second layer adhered to the middle layer by the second adhesive layer, wherein the first adhesive layer is made of acrylic adhesive and the second adhesive layer is made of silica gel.

2. The diaphragm of claim 1, wherein the middle layer is made of polyethylene terephthalate, and the first layer and the second layer are respectively made of polyetherimide, polyarylate, or polyethylene naphthalate.

3. A speaker, comprising a diaphragm, wherein the diaphragm comprises:

a middle layer, a first adhesive layer attached to one side of the middle layer;

a second adhesive layer attached to the other side of the middle layer;

a first layer adhered to the middle layer by the first adhesive layer, and a second layer adhered to the middle layer by the second adhesive layer, wherein the first adhesive layer is made of acrylic adhesive and the second adhesive layer is made of silica gel.

* * * * *